US005160904A

United States Patent [19]

Babbitt et al.

[11] Patent Number: 5,160,904

[45] Date of Patent: Nov. 3, 1992

[54] MICROSTRIP CIRCUIT WITH TRANSITION FOR DIFFERENT DIELECTRIC MATERIALS

[75] Inventors: Richard W. Babbitt, Fair Haven; Richard A. Stern, Allenwood, both of N.J.

[73] Assignee: The United States of America as represented by the Secretary of the Army, Washington, D.C.

[21] Appl. No.: 789,207

[22] Filed: Nov. 7, 1991

[51] Int. Cl.[5] ..... H01P 5/00

[52] U.S. Cl. ..... 333/34; 333/246

[58] Field of Search ..... 333/34, 246, 247

[56] References Cited

U.S. PATENT DOCUMENTS 2,754,484 7/1956 Adams ..... 333/246 X
3,519,962 7/1970 Lind ..... 333/246 X
4,749,966 6/1988 Stern et al. ..... 333/1.1
5,065,123 11/1991 Heckaman et al. ..... 333/246
5,101,182 3/1992 Babbitt et al. ..... 333/34 X

*Primary Examiner*—Paul Gensler
*Attorney, Agent, or Firm*—Michael Zelenka; William H. Anderson

[57] ABSTRACT

A composite microstrip circuit with a plurality of discrete microstrip components made from materials having different dielectric constants mounted thereon. A transitional taper is formed on each discrete microstrip component at the point where a connection is made between other components or devices. The base on which the discrete microstrip components are positioned has a dielectric constant lower than any of the dielectric constants of the discrete components. The transitional taper results in a low cost, low loss interconnection between discrete microstrip components.

1 Claim, 5 Drawing Sheets

FIG. 4
FIG. 4B
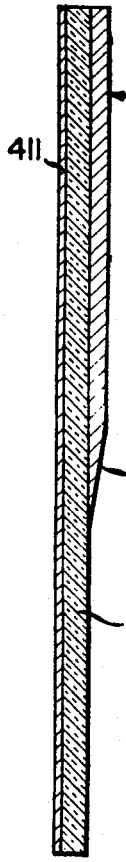
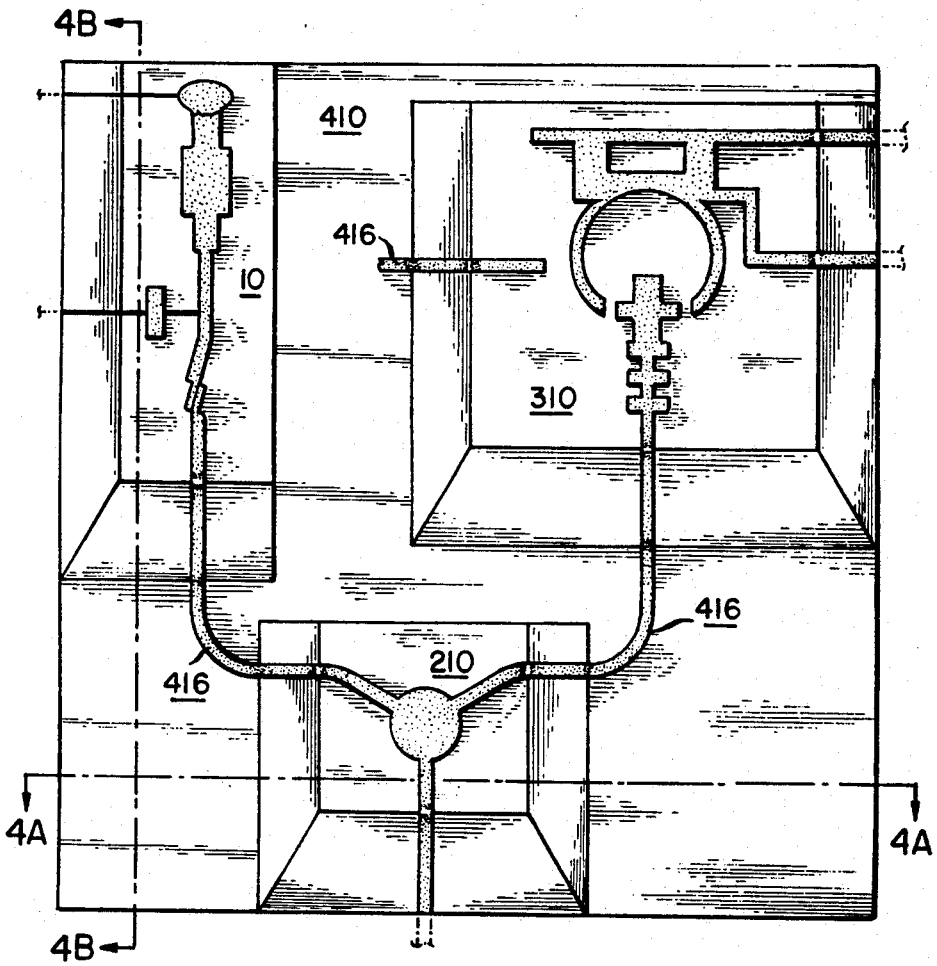
FIG. 4A
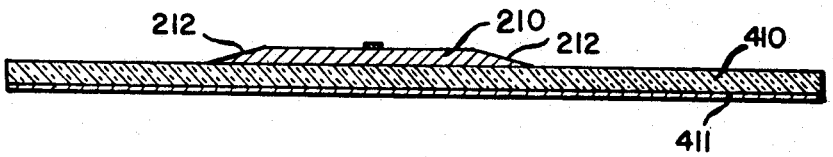

MICROSTRIP CIRCUIT WITH TRANSITION FOR DIFFERENT DIELECTRIC MATERIALS

STATEMENT OF GOVERNMENT RIGHTS

The invention described herein may be manufactured, used, and licensed by or for the government for governmental purposes without the payment to us of any royalties thereon.

FIELD OF THE INVENTION

This invention relates generally to composite circuits using microstrip construction, and more particularly to a structure for combining several discrete microstrip components using different dielectric materials.

BACKGROUND OF THE INVENTION

Microstrip circuits are used in many applications, such as radar or other applications involving millimeter wave or microwave frequencies. The use of microstrip circuitry is advantageous in that it is extremely small in size and low in weight, making it desirable for many applications in both the military and commercial equipment. Many applications involve the combination of several discrete microstrip components assembled to form a portion of or a complete system. Many of these discrete microstrip components are fabricated on a substrate of a material having dielectric properties that are advantageous or optimized for the particular function and construction of the discrete microstrip component. Therefore, in combining these discrete microstrip components, it is often necessary to assemble the components made from a wide range of dielectric materials with different dielectric constants. This often requires abutting the different dielectric materials together and fabricating quarter wavelength stubs and using metalization and soldering techniques for circuit continuity. These assembling techniques are difficult to accomplish and costly. Additionally, they are bandwidth limited resulting in increased circuit losses.

While advancements have been made in the assembly of microstrip components to other dielectric wave guide components, there has been little development in the assembly of discrete microstrip components with other discrete microstrip components. Two techniques for assembling a microstrip to a dielectric wave guide are disclosed in an article entitled "Straightforward Approach Using Broadband Transitions" by D. R. Singh and C. R. Seashore, which appeared in the September, 1984 issue of the "Microwaves and R. F. Magazine", and U.S. Pat. No. 4,745,377 entitled "Microstrip to Dielectric Wave Guide Transition" issuing to Stern et al on May 17, 1988, which is herein incorporated by reference. However, these two publications only disclose techniques for the assembly of a microstrip to a dielectric waveguide and do not provide any teaching of combining multiple discrete microstrip components together.

Therefore, there is a need for providing a technique to assemble discrete microstrip components easily and efficiently, while minimizing circuit losses.

SUMMARY OF THE INVENTION

The present invention comprises a structure for combining, with low loss, several discrete microstrip components onto a base. A base having a low dielectric constant is used to mount a plurality of microstrip components thereon. Each microstrip component is fabricated onto a substrate for optimizing the performance of the discrete microstrip component. Generally, the higher the dielectric constant of the optimized substrate, the thinner the substrate. Each substrate has a higher dielectric constant than the base. The edges of the substrate used to connect the microstrip components have a transitional taper that results in a low loss connection between the discrete microstrip components and the base.

Accordingly, it is an object of the present invention to easily connect several discrete microstrip components together with low loss.

It is an advantage of the present invention that it is easy to fabricate and assemble.

It is a feature of the present invention that a transitional taper is used between discrete microstrip component connections.

These and other objects, advantages, and features will become more readily apparent in view of the following detailed description.

BRIEF DESCRIPTION OF THE DRAWINGS

FIG. 4 is a plan view illustrating the present invention.

FIG. 4A is a cross section taken along line 4A—4A in FIG. 4.

FIG. 4B is a cross section taken along line 4B—4B in FIG. 4.

DETAILED DESCRIPTION OF THE PREFERRED EMBODIMENT

The present invention is illustrated with reference to a microstrip transceiver, used in radars as a transmitter and a receiver, comprised of three discrete microstrip components, a GUNN VCO, a mixer, and a circulator. The GUNN VCO, mixer, and circulator are well known microstrip devices or components in which the specific microstrip configuration thereof does not form a part of the present invention.

Figure 1:
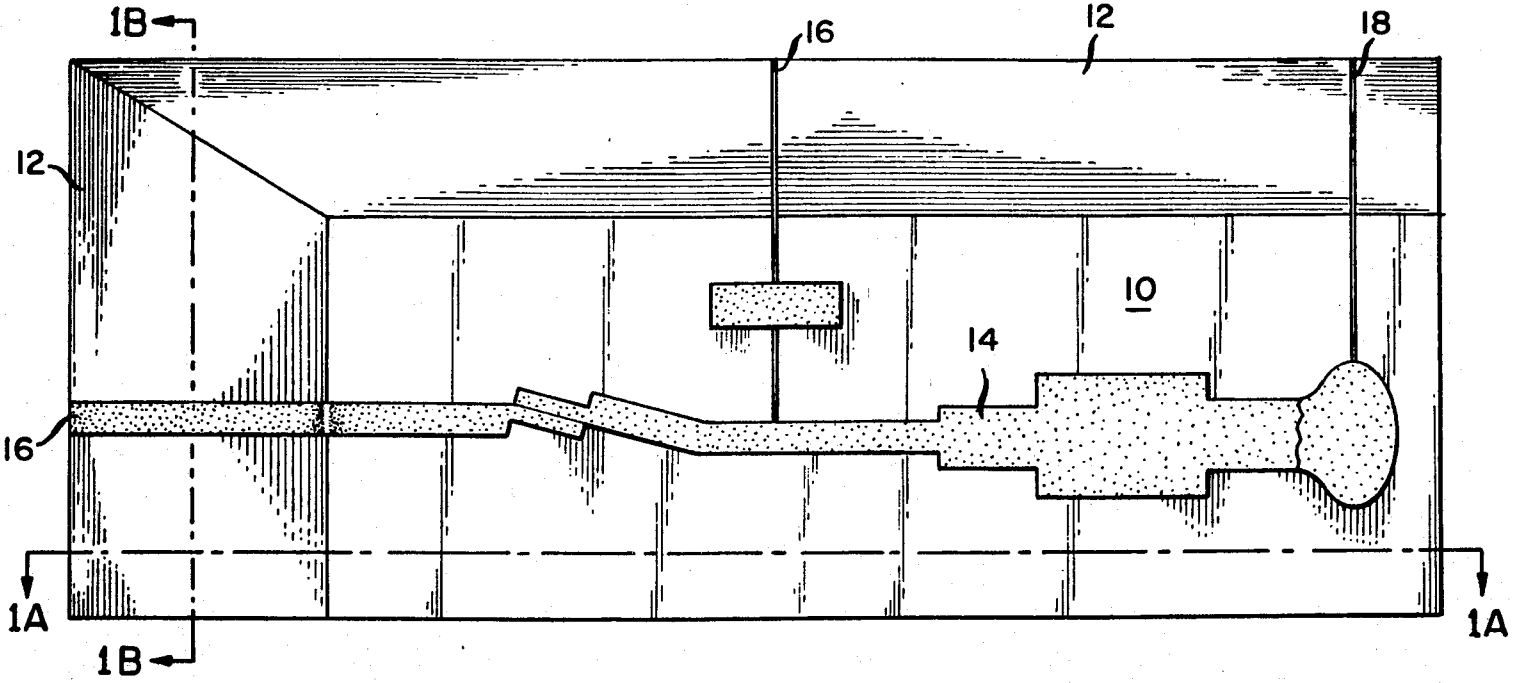
FIG. 1 is a plan view of a discrete microstrip component.
Figure 1A:
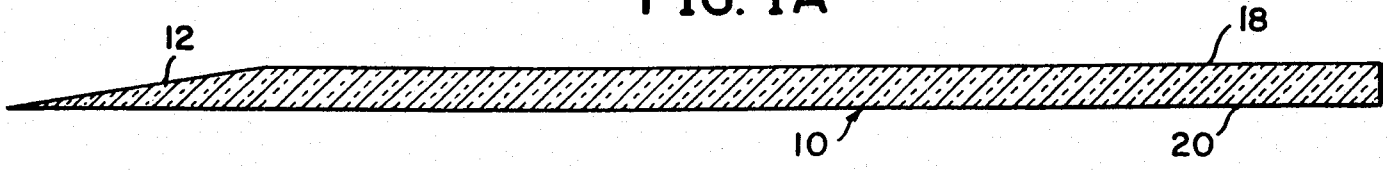
FIG. 1A is a cross section taken along line 1A—1A in FIG. 1.
Figure 1B:
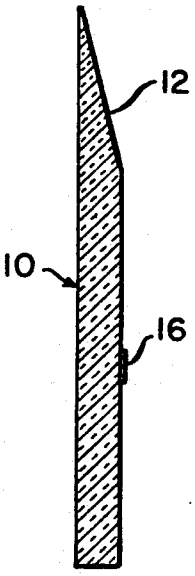
FIG. 1B is a cross section taken along line 1B—1B in FIG. 1.

FIG. 1 illustrates a GUNN VCO on a substrate 10 incorporating the teachings of the present invention. Substrate 10 is preferably made of quartz having a dielectric constant of 3.8. The substrate 10 has tapered edges 12. The microstrip portion of the component 14 has a well known configuration for use as a GUNN VCO. The points at which the discrete microstrip component illustrated in FIG. 1 connect to other devices or components is illustrated by component connections 16. At each component connection 16, the substrate 10 has tapered edges 12. FIGS. 1A and 1B are cross sections of the discrete microstrip component. The tapered edges 12 can clearly be seen in FIGS. 1A and IB. The substrate 10 has a top surface 18 and a bottom surface 20. The substrate 10 is substantially planar. The tapered edges 12 form a transitional taper from the top surface 18 to the bottom surface 20 of substrate 10. The transitional taper is linear and extends from the thickest portion adjacent top surface 10 to the thinnest portion at one end adjacent bottom surface 20. Thereby the transitional taper acts to gradually reduce the thickness of the substrate 10 over the length of the transitional taper.

Figure 2B:
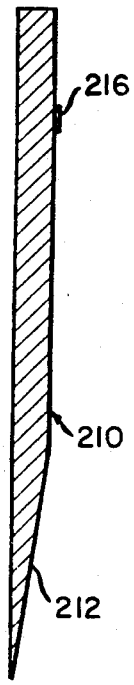
FIG. 2B is a cross section taken along line 2B—2B in FIG. 2.
Figure 2:
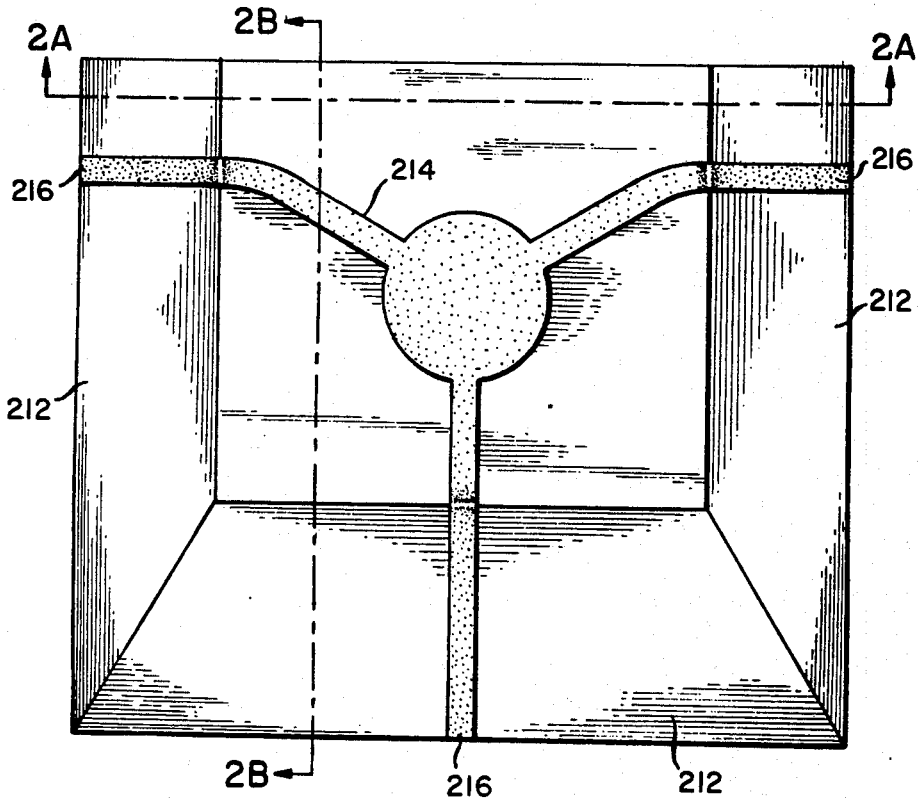
FIG. 2 is a plan view of another discrete microstrip component.
Figure 2A:
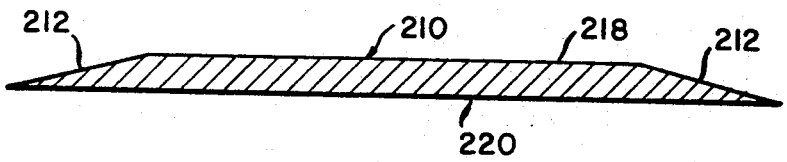
FIG. 2A is a cross section taken along line 2A—2A in FIG. 2.

FIG. 2 illustrates another discrete microstrip component having a substrate 210 made of ferrite having a dielectric constant of 12. The substrate 210 has tapered edges 212 thereon. The microstrip portion of the component 214 forms a circulator. The specific structure of the circulator is well known and does not form a part of the present invention. The discrete microstrip component illustrated in FIG. 2 is connected, coupled, or attached to other elements of a composite circuit by component connectors 216. FIG. 2A is a cross section more clearly illustrating the tapered edges 212 on substrate 210. The substrate 210 is primarily planar having a top surface 218 and a bottom surface 220. The tapered edges 212 forms a transitional taper from the top surface 218 to the bottom surface 220 of substrate 210. Similarly, FIG. 2B is a cross section of substrate 210, clearly illustrating the tapered edge 212.

Figure 3:
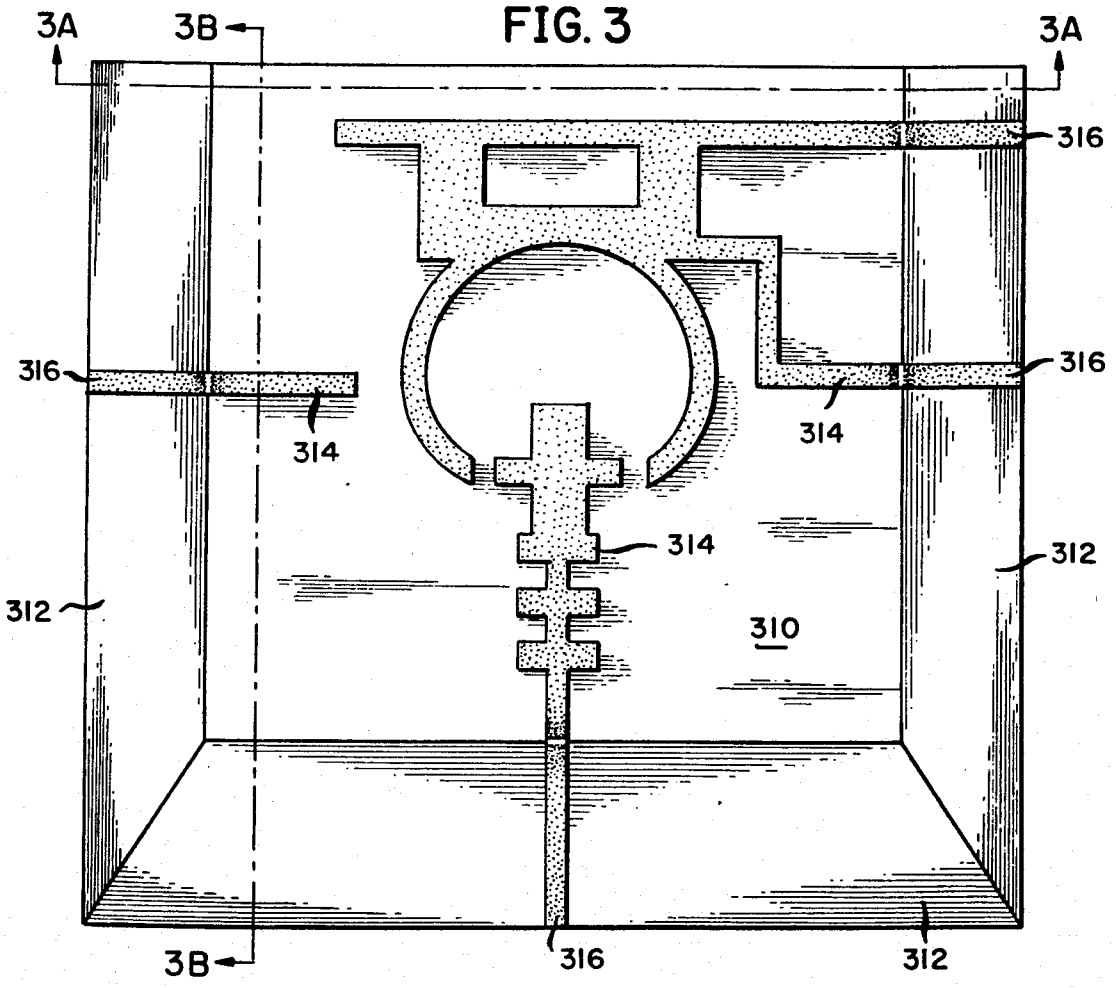
FIG. 3 is a plan view of yet another discrete microstrip component.
Figure 3A:
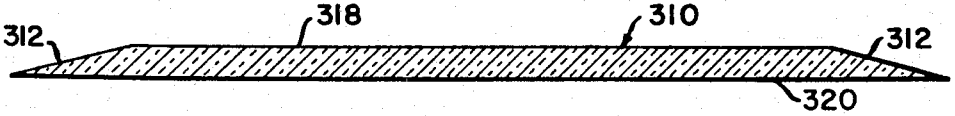
FIG. 3A is a cross section taken along line 3A—3A in FIG. 3.
Figure 3B:
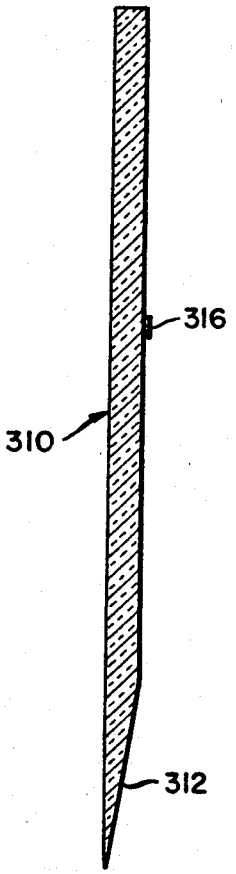
FIG. 3B is a cross section taken along line 3B—3B in FIG. 3.

FIG. 3 illustrates yet another microstrip component comprising substrate 310 having tapered edges 312. Substrate 310 is made of sapphire having a dielectric constant of 9. The microstrip portions 314 of the microstrip component form a configuration of a mixer. The mixer configuration is well known and does not form a part of the present invention. The discrete microstrip component illustrated in FIG. 3 is connected, coupled, or attached to other elements of a composite circuit by component connectors 316. FIG. 3A is a cross section of substrate 310 more clearly illustrating the tapered edges 312. Substrate 310 is primarily planar and has a top surface 318 and a bottom surface 320. Similarly, FIG. 3B is another cross section of substrate 310 also clearly illustrating the tapered edges 312. The tapered edges 312 are positioned along each edge where a component connection 316 is formed. The tapered edges 312 form a transitional taper from the top surface 318 to the bottom surface 320 of substrate 310.

FIG. 4 illustrates the three discrete microstrip components illustrated in FIGS. 1-3, assembled or mounted onto a base 410. Base 410 is made of a material having a dielectric constant of 2.2. Such a material is widely available and is referred to as Duroid. Duroid is a proprietary product of Rogers Corporation consisting of woven glass/PTFE laminates. The dielectric constant of the base 410 is lower than that of any of the dielectric constants of the substrate materials forming the microstrip components. Base component connectors 416 connect the three discrete microstrip components together, as well as to other circuitry not illustrated. The three microstrip components mounted on base 410 merely illustrate the application of the present invention. The present invention is applicable to any type of microstrip component and is not limited to the forms illustrated herein. The microstrip components illustrated herein function as a transceiver for use in electronic equipment such as radar, typically in the millimeter wave frequencies. The three discrete microstrip components are mounted onto the base 412 by any conventional means such as bonding or epoxy. FIG. 4A illustrates a cross section of the composite microstrip device illustrated in FIG. 4. A ground plane 411 is fabricated of a conductive material such as copper or silver, and applied to the entire bottom surface of substrate 410. The ground plane 411 serves the same purpose as its use in a conventional microstrip device. FIG. 4A additionally clearly illustrates the tapered edges 212 on the substrate 210 which is attached or mounted to base 410. Similarly, FIG. 4B is a cross section of the composite microstrip device illustrated in FIG. 4. The tapered edge 412 can clearly be seen on substrate 10.

Figure 5:
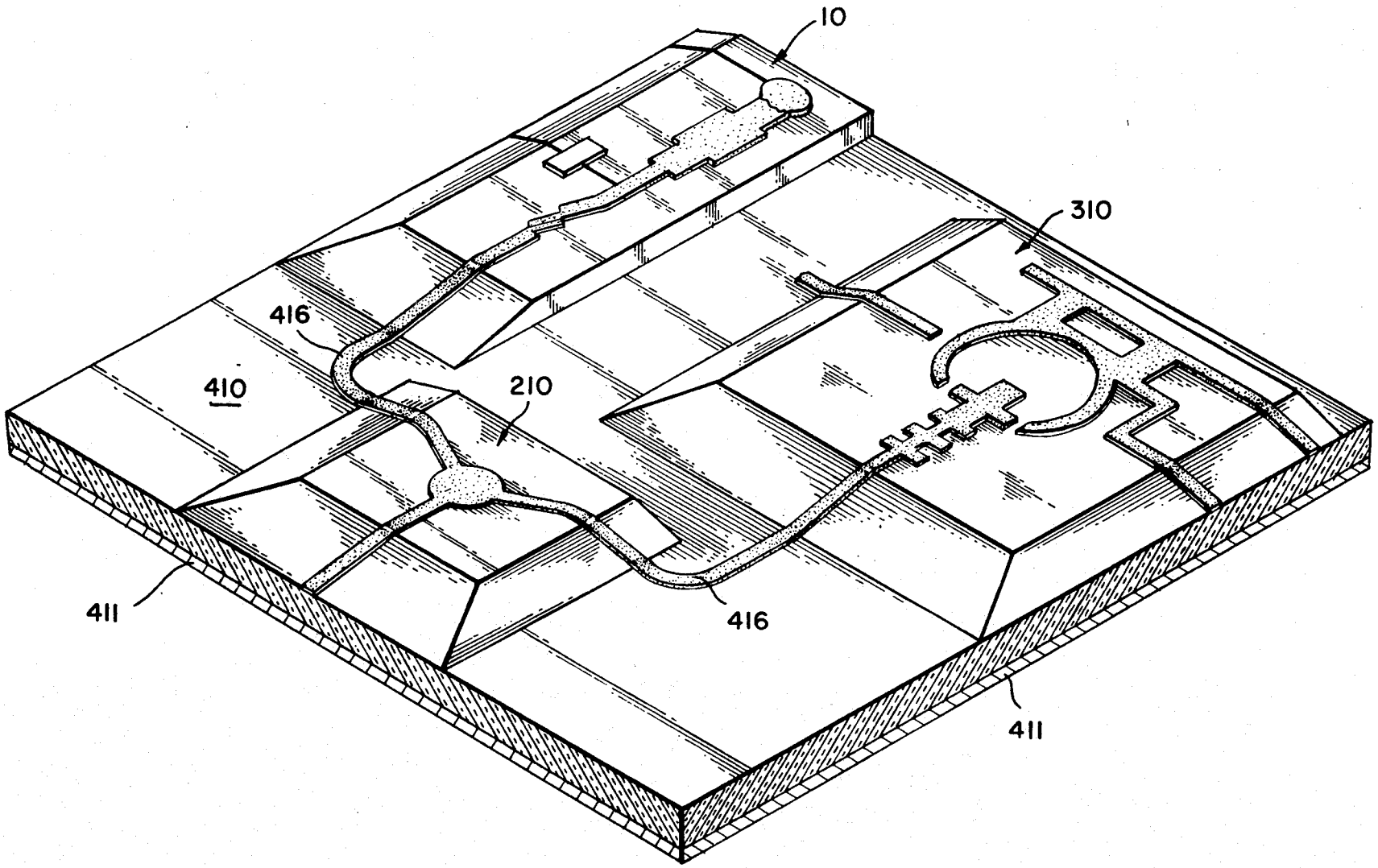
FIG. 5 is a perspective view illustrating the present invention.

FIG. 5 is a perspective view clearly illustrating the composite microstrip assembly comprised of base 410 and the three discrete microstrip components comprising a GUNN VCO, circulator, and mixer. At the points on each component that are connected to other devices or components, a tapered edge or transitional taper is formed on each substrate. This permits a connection to be made to the base component connectors 416 formed on the base 410. Each of the discrete microstrip components are fabricated onto a substrate that will produce the best performance for the particular component. The transition to and from the discrete microstrip components is achieved by a taper at each of the edges thereof where the discrete microstrip components are connected to other microstrip devices or components. The transitional taper does not result in any substantial impedance change, since increased thickness causes an impedance increase, while the higher dielectric constant of the substrate causes an impedance decrease. These offsetting impedance changes produce only a small impedance change going from a thin low dielectric constant to a thicker higher dielectric constant material. This transitional taper has been measured to have a 20% bandwidth and is a low cost, low loss technique for fabricating microstrip circuits. The present invention permits the interconnection of multiple discrete components using a single transmission media, but having different dielectric materials.

Therefore, the structure of the present invention has many practical applications in the fabrication of electronic equipment using microstrip technology. Only one such example as applied to a microstrip transceiver has been given. It will be obvious to those skilled in the are that various modifications may be made without departing from the spirit and scope of this invention.

What is claimed is:

1. A composite microstrip circuit comprising:

a base of dielectric material with a predetermined dielectric constant, the base having a top and bottom surface;

a plurality of substrates with predetermined dielectric constants higher than the dielectric constant of the base, the plurality of substrates having top, bottom, and edge surfaces wherein each of the edge surfaces of each of the substrates tapers linearly from the bottom surface of the substrate to a predetermined height and connects to the top surface of the substrate thereby causing a linear increase in thickness of each of substrates, the plurality of substrates mounted on the top surface of the base such that the top surface of the base abuts the bottom surface of each substrate, thereby forming a substrate-base junction;

a plurality of discrete microstrip components mounted on the top surface of the plurality of substrates; and a plurality of microstrip transmission lines electrically connecting the discrete microstrip components in a predetermined manner wherein the microstrip transmission lines connected to the microstrip components electrically extend over and mount onto the top and edge surfaces of the plurality of substrates and the top surface of the base, whereby the higher dielectric constant of the substrate offsets the increase of impedance in the transmission lines extending over and mounted on the edge surface of the substrates due to the increase in thickness of the substrate.

* * * * *

UNITED STATES PATENT AND TRADEMARK OFFICE

CERTIFICATE OF CORRECTION

PATENT NO. : 5,160,904

DATED : November 3, 1992

INVENTOR(S) : RICHARD W. BABBITT, RICHARD A. STERN

It is certified that error appears in the above-identified patent and that said Letters Patent is hereby corrected as shown below:

Column 4, claim 1, line 64, after "each of" and before "substrates" insert --the--;

Signed and Sealed this

Twenty-third Day of November, 1993

*Attest:*

*Attesting Officer*

BRUCE LEHMAN

*Commissioner of Patents and Trademarks*